US009516895B2

(12) United States Patent
Awty et al.

(10) Patent No.: US 9,516,895 B2
(45) Date of Patent: Dec. 13, 2016

(54) ADDITIVE RELEASE COMPONENT

(75) Inventors: Edward Awty, London (GB); Charanjit Nandra, London (GB); Alfred Vincent Spencer, London (GB); Paul Frobisher, Clevedon (GB); Michael Newnham, Clevedon (GB); Richard Harbutt, Surrey (GB); Jane Nicholls, London (GB); Derek Roberts, Surrey (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 508 days.

(21) Appl. No.: 14/116,985

(22) PCT Filed: May 11, 2012

(86) PCT No.: PCT/GB2012/051042

§ 371 (c)(1),
(2), (4) Date: Mar. 17, 2014

(87) PCT Pub. No.: WO2012/156698

PCT Pub. Date: Nov. 22, 2012

(65) Prior Publication Data

US 2014/0182607 A1 Jul. 3, 2014

(30) Foreign Application Priority Data

May 13, 2011 (GB) ..... 1108025.6
May 13, 2011 (GB) ..... 1108057.9

(51) Int. Cl.
*A24D 3/06* (2006.01)
*A24D 3/04* (2006.01)

(52) U.S. Cl.
CPC ..... *A24D 3/061* (2013.01); *A24D 3/048* (2013.01)

(58) Field of Classification Search
USPC ..... 131/280, 335, 337, 352
See application file for complete search history.

(56) References Cited

U.S. PATENT DOCUMENTS 2,755,206 A * 7/1956 Statia, Sr. ..... A24D 3/061 131/187
3,428,049 A * 2/1969 Cogbill ..... A24D 3/061 131/337

(Continued)

FOREIGN PATENT DOCUMENTS

EP 0276021 A2 7/1988
EP 1972213 A1 9/2008

(Continued)

OTHER PUBLICATIONS

Definition of valve, the Free Dictionary by Farlex, [online], retrieved from the Internet, [retrieved Apr. 27, 2016], <URL:http://www.thefreedictionary.com/valve>.*

(Continued)

*Primary Examiner* — Dennis Cordray
(74) *Attorney, Agent, or Firm* — Cantor Colburn LLP

(57) ABSTRACT

A deformable additive release component (1) for a smoking article is disclosed, comprising an aperture (8) through which additive may be released, an outer wall section (2), an inner wall section (3) that defines a chamber (10) within which the additive is held and at least one channel (5) between the inner and outer wall sections to allow airflow through the component, wherein the component is configured to transmit a compressive force applied to the outer wall section to the inner wall section and to open the aperture. A filter (25) for a smoking article that comprises said additive release component, and a smoking article (21) that comprises said additive release component or said filter, (Continued)

are also described. Methods of manufacturing the additive release components is also disclosed.

14 Claims, 5 Drawing Sheets

(56) References Cited

U.S. PATENT DOCUMENTS

| | | | | |
|---|---|---|---|---|
| 3,515,146 | A | 6/1970 | Nealis | |
| 3,884,246 | A * | 5/1975 | Walker | A24D 3/061 131/337 |
| 4,201,316 | A * | 5/1980 | Klingaman | B05B 11/0078 222/136 |
| 4,865,056 | A * | 9/1989 | Tamaoki | B65D 17/06 131/173 |
| 5,133,367 | A | 7/1992 | Keritsis | |
| 5,331,981 | A * | 7/1994 | Tamaoki | A24B 15/00 131/335 |
| 5,845,649 | A * | 12/1998 | Saito | A24B 15/165 131/194 |
| 7,578,298 | B2 * | 8/2009 | Karles | A24D 3/163 131/337 |
| 7,878,962 | B2 * | 2/2011 | Karles | A24D 3/0216 131/337 |
| 7,946,294 | B2 * | 5/2011 | Sherwood | A24D 3/0225 131/328 |
| 2002/0153017 | A1 | 10/2002 | Georgitsis et al. | |
| 2005/0268926 | A1 | 12/2005 | Hsu et al. | |
| 2012/0024305 | A1 * | 2/2012 | Liu | A23L 1/22016 131/332 |
| 2013/0239984 | A1 * | 9/2013 | Reed | A24D 3/061 131/337 |

FOREIGN PATENT DOCUMENTS

| | | | |
|---|---|---|---|
| JP | 63-276474 | A | 11/1988 |
| JP | 64-080273 | A | 3/1989 |
| JP | 2002-335937 | A | 11/2002 |

OTHER PUBLICATIONS

International Search Report and Written Opinion, mailed Sep. 7, 2012 for PCT/GB2012/051042, filed May 11, 2012.

Written Opinion, mailed Apr. 25, 2013 for PCT/GB2012/051042, filed May 11, 2012.

International Preliminary Report on Patentability, mailed Aug. 30, 2013 for PCT/GB2012/051042, filed May 11, 2012.

Office Action, dated Oct. 28, 2014, for JP Application No. 2014-509833 [English translation].

* cited by examiner

ADDITIVE RELEASE COMPONENT

CLAIM FOR PRIORITY

This application is a National Stage Entry entitled to and hereby claiming priority under 35 U.S.C. §§365 and 371 to corresponding PCT Application No. PCT/GB2012/051042, filed May 11, 2012, which in turn claims priority to GB Application No. 1108057.9, filed May 13, 2011, and which claims priority to GB Application No. 1108025.6, filed May 13, 2011. The entire contents of the aforementioned applications are herein expressly incorporated by reference.

TECHNICAL FIELD

The present invention relates to additive release components for smoking articles.

BACKGROUND

As used herein, the term "smoking article" includes smokeable products such as cigarettes, cigars and cigarillos whether based on tobacco, tobacco derivatives, expanded tobacco, reconstituted tobacco or tobacco substitutes and also heat-not-burn products (i.e. products in which flavour is generated from a smoking material by the application of heat without causing combustion of the material) and other articles capable of generating tobacco derived aerosols. Typically, smoking articles are provided with filters for removing constituents from the gaseous flow.

It is known to incorporate additive release components—components that contain and release additives such as flavourants—into smoking articles. An incorporated component is often actuated by the user of the smoking article applying a force to the outside of the smoking article, thereby breaking the additive release component and initiating the release of additive.

SUMMARY

According to a first aspect, there is provided an additive release component for a smoking article that is deformable and is configured to provide an aperture through which additive may be released, an outer wall section, an inner wall section that defines a chamber within which additive is held, and at least one channel between the inner and outer wall sections to allow airflow through the component, wherein the component is configured to transmit a compressive force applied to the outer wall section to the inner wall section and to open the aperture.

In some embodiments, the additive release component is resiliently deformable.

In some embodiments, one or more bridges and/or vanes connect the outer wall section to the inner wall section.

In some embodiments, the component is configured to release a plurality of discrete deliveries of additive.

In some embodiments, the aperture is sealed to prevent the release of additive through said aperture prior to the first actuation of the additive release component, and wherein the first application of compressive force to the additive release component opens the aperture to allow release of additive through said aperture.

In some embodiments, the aperture closes once the compressive force is no longer applied, so that substantially no additive is released until a compressive force is applied once more.

For example, the aperture is a slit valve. Alternatively, the aperture may be sealed by a plug comprising a rupturable material.

In some embodiments, the chamber comprises two compartments, wherein each compartment contains a different additive.

In some embodiments, at least part of the component is injection moulded from polyvinyl alcohol (PVOH) and/or polyethylene (PE).

According to a second aspect, there is provided a filter for a smoking article that comprises an additive release component according to the first aspect.

In some embodiments, the filter comprises a transparent and/or translucent window to enable the user to see the additive release component.

In some embodiments, the filter comprises a wicking element.

In some embodiments, the additive release component is substantially aligned with the longitudinal axis of the filter.

According to a third aspect, there is provided a smoking article comprising an additive release component according to the first aspect, or a filter according to the second aspect.

According to a fourth aspect, a method of manufacturing an additive release component according to some embodiments of the first aspect is provided, the method comprising: forming an inner wall section that defines an open chamber and an outer wall section; introducing an additive into the open chamber; and adding a sealing structure to seal the open chamber.

BRIEF DESCRIPTION OF THE DRAWINGS

Embodiments of the present invention will now be described, by way of example only, with reference to the accompanying drawings, in which.

DETAILED DESCRIPTION

Figure 1A:
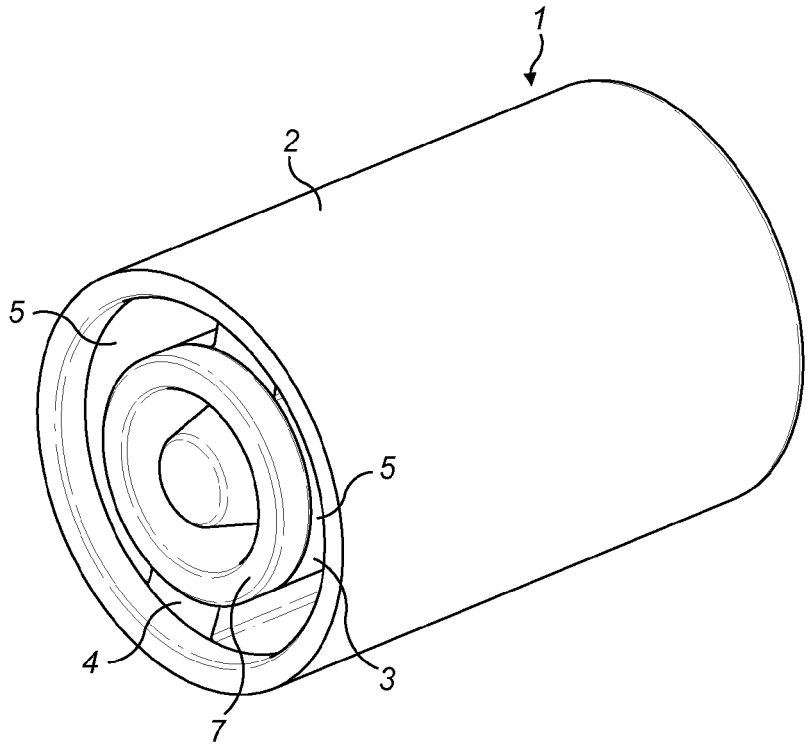
FIG. 1*a* is shows a perspective view of an additive release component according to a first embodiment.

According to a first aspect, there is provided an additive release component for a smoking article that is deformable and is configured to provide an aperture through which additive may be released, an outer wall section, an inner wall section that defines a chamber within which additive is held, and at least one channel between the inner and outer wall sections to allow airflow through the component, wherein the component is configured to transmit a compressive force applied to the outer wall section to the inner wall section and to open the aperture.

An additive release component is anything that is capable of retaining an additive, before releasing it as and when desired.

In some embodiments of the present invention, an additive release component for a smoking article is provided in which the component is resiliently deformable and is configured to provide an aperture through which additive may be released (also referred to as a release aperture) upon actuation of the additive release component. The additive is held in a chamber at least partially defined by an inner wall section. The release aperture is closed prior to the first actuation of the additive release component and this may seal the chamber holding the additive and prevent the additive from leaving the additive release component prior to actuation. Upon actuation, the release aperture is opened and a portion of the additive held within the component is released through it.

The chamber of the additive release component is filled with the additive through a filling aperture. The filling aperture may be the same as the release aperture or it may be a different aperture.

Where the filling and release apertures are different, the filling aperture may be sealed after filling so that the filling aperture is not re-opened upon actuation of the additive release component. This arrangement with separate filling and release apertures may, in some embodiments, be beneficial as the filling aperture may be configured to facilitate the introduction of the additive into the chamber of the additive release component. For example, it may not be necessary for the component to be deformed or otherwise specifically manipulated in order to open the filling aperture and to keep it open during filling. Alternatively or additionally, in some embodiments the filling aperture may be larger than might be convenient or possible with a filling aperture which must subsequently act as a release aperture, especially where the release aperture is to close and/or reseal in between actuations. The separate filling aperture may be easily sealed by a sealing structure, such as a cap, in such a way that no additive is released through that aperture.

In another embodiment, the filling aperture may be closed or sealed by a sealing structure, such as a cap, the sealing structure including a release aperture.

In embodiments where the filling and release aperture are the same, the aperture may be sealed after the additive release component has been filled with additive so that the additive cannot exit the component prior to actuation. However, upon actuation of the component, the seal will break, allowing the additive to exit the component via the aperture.

Actuation may involve the application of a compressive force to the outer wall section of the additive release component. The compressive force applied to the outer wall section is transmitted to the inner wall section in such a manner that the aperture is opened. Alternatively or in addition, the force is transmitted from the outer wall section to the inner wall section in such a way that the inner wall is deformed so as to compress or otherwise distort the chamber holding the additive and to force a portion of the additive out of the chamber through the aperture.

In some embodiments, additive release component comprises a filling aperture through which the additive in introduced into the chamber. Once the additive has been added, the aperture is covered and/or sealed. In some embodiments, the filling aperture is sealed by a heat seal or wet seal, or the like. This may be preferred where the filling aperture is also the release aperture and so the filling aperture seal does not have to withstand the actuation of the additive release component without opening. Alternatively, the filling aperture may be sealed by a sealing structure such as a cap which fits over and/or into the aperture to seal it. The use of a sealing structure may be preferred where the filling aperture must remain closed throughout the use of the additive release component (and following compression), for example where the component has a separate release aperture.

The additive release component may be a one-part additive release component, i.e. the whole additive release component is formed from a single part. In other embodiments, the additive release component comprises two or more parts. For example the outer wall section, the inner wall section, the sealing structure and/or the seal may all be separate parts. Separate parts may be held together by any suitable sealing or, in some cases, by friction fit.

In some embodiments, the additive release component comprises an exterior surface which is at least partially cylindrical, the outer wall section having, for example, a substantially circular cross-section. Alternatively or in addition, the additive release component may substantially fill the cross-section of the smoking article into which it is incorporated. In some preferred embodiments, at least a portion of the external surface of the outer wall is parallel to and preferably lies adjacent to and/or in contact with, the surface wrapping of the smoking article into which the component is incorporated. In some embodiments, the additive release component is simply directly surrounded by a paper wrapper, such as tipping paper, when incorporated into a smoking article, to effectively allow the user to directly actuate the component by squeezing the relevant part of the smoking article, at least a part of the additive release component lying directly below the surface wrapping of the smoking article.

In some embodiments, the additive release component is configured to allow airflow through the component. In some embodiments, the air flows through a gap between the inner and outer wall sections. The section of the component joining these two wall sections is preferably configured, for example with gaps, to form bridging structures between the inner and outer wall sections whilst creating channels for air to flow longitudinally through the additive release component.

The additive release component is resiliently deformable. In some embodiments, when a compressive force is applied to the component to actuate the component, the component deforms, and when compressive force is no longer applied towards the component, the component substantially returns to its original shape. When the component is deformed by the application of compressive force, additive may be released through a release aperture. In some embodiments, when the compressive force is no longer applied, the release aperture closes or substantially closes, so that little or no additive is released until the next actuation of the additive release component. In some embodiments, upon a second and/or subsequent actuation of the additive release component, the release aperture is once again opened and a further portion of the additive is released.

The additive release component may be composed of one or more suitable materials. The additive release component of the invention is resiliently deformable but may, in addition to resiliently deformable materials, comprise one or more materials that are frangible or plastically deformable.

The additive release component may be composed of a low solubility, high molecular weight polyvinyl alcohol (PVOH) and/or may be composed of polyethylene (PE), for example.

Alternatively or in addition, the additive release component may be composed of other suitable materials, such as gelatine, cellulose, and various cellulose derivatives (e.g. hydroxypropylmethyl cellulose). Many known biodegradable materials may also be suitable, such as high molecular weight polyethylene glycols, polylactic acid, plastarch material, polycaprolactone, polyglycolide, a polyhydroxyalkanoate such as poly-3-hydroxybutyrate, and zein-derived bioplastics. The additive release component may comprise a hollow foodstuff material, such as pasta; an extruded hollow tubing of reconstituted tobacco material; a wax, such as beeswax, candelilla, carnauba, shellac wax, caranday, sugarcane wax, myrtle wax, and petroleum wax; a resin, such as epoxy resin, terpene resin, petroleum resin, ester gum, phenolic resin, and rosin-based resin; a natural or synthetic gum, such as gum arabic, locust bean, guar, alginate, carrageenan, and pectin; latex; and/or a plastic.

Thus, in some embodiments, the additive release component is able to provide the release of additive in a plurality of discrete deliveries. A portion of the additive held in the additive release component may be released upon each actuation of the component.

In some embodiments, the amount of additive released by an actuation of the additive release component may be determined by the degree of compressive force applied. In addition or alternatively, the amount of additive released from the additive release component may be determined by the number of actuations, that is, the number of times the additive release component is compressed.

Additive is released from the additive release component through a release aperture. The additive release component may comprise one or more release apertures, and each aperture may be located at any suitable location of the component, may be of any suitable size, and may be of any suitable shape. In some embodiments, the release aperture may be a hole, such as a pin-hole, or a slit. In some embodiments, the release aperture is formed in the inner wall section. Alternatively, the release aperture may be formed in an additional part of the additive component, for example in a sealing structure which seals the additive-retaining chamber.

In some embodiments, the release aperture is not actually formed until the additive release component is actuated. In such embodiments, the aperture may be formed upon actuation by local rupture, tearing or the like of the material of the inner wall section. For example, a weakened or thinner portion of the wall may be provided. Alternatively or in addition, the inner wall may be shaped to rupture or tear in a particular way upon actuation. This type of release aperture formed by actuation must, however, be of a suitable limited size and shape to allow the aperture to at least partially close again after actuation, to at least partially reseal the chamber.

In some embodiments, the release aperture is covered and/or sealed prior to the first actuation of the additive release component. The aperture may be sealed without the need for an additional part. For example, a hole or slit may be closed by heat sealing. Alternatively, one or more seals may close the release aperture of the component. For example, the seal may comprise a sealing sheet or similar structure which covers the release aperture. Alternatively or in addition, the seal may comprise a plug or similar structure which at least partially fills the release aperture. The seal may comprise the same material as the inner wall section or it may comprise a different material.

In some embodiments, the inner and/or outer wall sections of the additive release component, an optionally any seal and/or sealing structure, may be formed from polyvinyl alcohol (PVOH) and/or polyethylene (PE). In further embodiments, the optional sealing structure may be formed from polyvinyl alcohol (PVOH) and/or polyethylene (PE).

The seal may help prevent the release of additive from the additive release component until the first actuation of the additive release component. When the first compressive force is applied, the seal may rupture or tear, or the sealing structure may rupture or may be move or removed. Removal of a plug may, in some embodiments, be as a result of the actuation forcing the additive towards the aperture and against the seal, so that the seal is eventually pushed out of the way and the additive is ejected out through the release aperture. Alternatively, the seal may comprise a section that is sufficiently thin and/or weak to rupture upon actuation, either as a result of the deforming of the seal, deforming of the inner wall section, or under force from the additive trying to exit the chamber.

In still further embodiments, the additive release component comprises a release aperture that is a slit valve. Alternatively or in addition, the additive release component may comprise a release aperture that is sealed by a plug comprising a rupturable material.

In some embodiments, the release aperture through which the additive is released from the additive release component is a slit valve. The slit valve is preferably configured to open upon actuation of the additive release component, for example upon application of a compressive force to the outer wall section, and to close and re-seal once actuation has stopped and the compressive force is no longer applied.

The additive release component comprises an outer wall section and an inner wall section. In some embodiments, these sections are connected at at least one point, for example by one or more bridging sections and/or vanes. The wall sections must be connected so as to allow the force applied to the outer wall section to be transmitted to the inner wall section. In addition, in some embodiments, the wall sections are spaced from one another so that it is possible for air to flow through the additive release components between the wall sections. This airflow is preferably not completely blocked by the bridging structure(s) or vane(s) connecting the wall sections.

The provision of one or more channels between the inner and outer wall portions to allow airflow through the additive release component may be advantageous as it may allow the additive release component to substantially fill the cross-section of the smoking article without causing significant draw resistance (i.e. pressure drop) during use of the smoking article.

In some embodiments in which the additive release component does substantially fill the cross-section of the smoking article, the cumulative cross-sectional area of the one or more channels between the inner and outer wall sections of the component may at least 20%, at least 25%, or at least 30% of the total cross-sectional area of the smoking article.

In some embodiments, the additive release component may substantially fill the cross-section of a smoking article. In some embodiments, this may mean that the external surface of the additive release component is at least partially in direct contact with any wrapper surrounding the section of the smoking article (rather that the component being surrounded by a void or being surrounded by a layer of material such as filter material or smokeable filler material.

In such embodiments, the additive release component may potentially hold a greater volume of additive than a conventional additive release component. According to some embodiments, the additive release component may hold up to 80 μl of additive, up to 100 μl or up to 150 μl of additive. Alternatively or in addition, the additive release component may hold at least 10 μl of additive, at least 18 μl, at least 20 μl, at least 25 μl or at least 30 μl of additive. In some embodiments, the volume of additive stored in the additive release component is approximately 70 μl.

The additive release component is configured to transmit the compressive force applied to the outer wall section of the component to the inner wall section of the component, thereby enabling the application of compressive force to the outer wall to deform the inner wall section is such a way as to open the release aperture and allow release of the additive. In some embodiments, this transmission of the force is via the bridging structure or vanes which connect the inner and outer wall sections. As discussed above, these bridging structures or vanes may bridge a gap between the wall sections, preferably without preventing the flow of air between them. The bridging structures or vanes ensure that the force applied to the outer wall section is transmitted to the inner wall section in a focused and predictable manner, and ensures that the gap or void between the wall sections does not create a cushion which lessens or dissipates the force applied to the outer wall section. The focused force transmitted to the inner wall section opens the release aperture and ejects the additive from the additive release component. In addition to the opening of the release aperture, in some embodiments the force transmitted to the inner wall section may cause the inner wall section to be deformed so as to reduce the volume of the chamber holding the additive and to force the additive out through the release aperture.

Figure 1B:
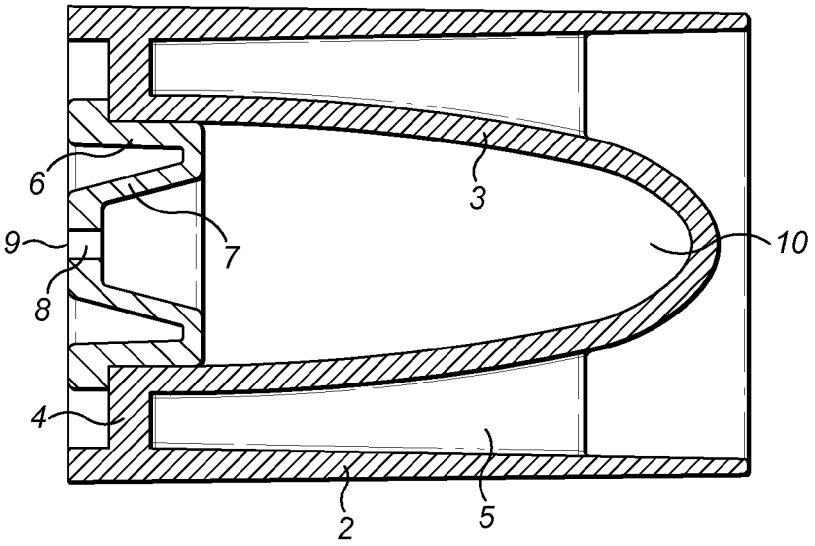
FIG. 1*b* shows a longitudinal cross-sectional view of an additive release component according to the first embodiment.

FIGS. 1*a* and 1*b* show an additive release component 1 according to a first embodiment of the current invention. The additive release component comprises an outer wall section 2 and an inner wall section 3 connected in the illustrated embodiment by two bridging structures 4 positioned at one end of the wall sections. The inner wall section 3 defines a chamber 10 for containing additive. There is a gap between the inner and outer wall sections forming a channel 5 through which air and/or smoke may flow through the additive release component.

A filling aperture 6 is formed by the open end of the inner wall section, forming an opening in the chamber 10 holding the additive. This filling aperture 3 is closed by a sealing structure 7 which is in the form of a cap fitted over and into the aperture. The sealing structure 7 includes a release aperture 8 which is sealed by a sealing sheet 9 attached to the end of the sealing structure 7 and covering the release aperture 8. This sealing sheet 9 is removed or ruptured when the additive release component is actuated and the force applied to the outer wall section 2 is transmitted via the bridging structures 4 to the inner wall section 3 and the sealing structure 7.

During manufacture of the additive release component according to the first embodiment, the filling aperture 6 is sealed by the sealing structure 7 after additive has been inserted into the chamber 10 of the additive release component 1 through the filling aperture 6. The sealing structure 7 may be held in position by any means. For example, it may be wet sealed or may held by friction-fit. As a result, additive is initially prevented from being released from the component 1.

Additive may be released from the component, however, when the additive release component 1 is actuated by a first application of a compressive force by the user of the smoking article. The application of compressive force compresses the outer wall section 2 of the component. Via the bridging structures 4 the inner wall section 3, the filling aperture 6 and sealing structure 7 are deformed. This decreases the volume of the additive-containing chamber 10, and forces the additive against the release aperture 8 in the sealing structure 7. The force of the additive and/or the deforming of the sealing structure 7 rupture the sealing sheet 9 which is positioned over the release aperture 8 in the sealing structure 7. This opens the release aperture 8 in the sealing structure 7, allowing a portion of the additive to leave the additive release component 1.

When compressive force is no longer applied, the resiliently deformable additive release component 1 returns to its original shape and size. This leads the sealing sheet 9 to partially re-seal the release aperture 8 of the sealing structure 7. This reduces or preferably stops the release of additive. Further actuation of the additive release component by a further application of a compressive force will lead to the re-opening of the release aperture 8 in the sealing structure 7, allowing the release another discrete delivery of additive. This may be repeated until there is substantially no more additive left in the component for release.

Figure 1C:
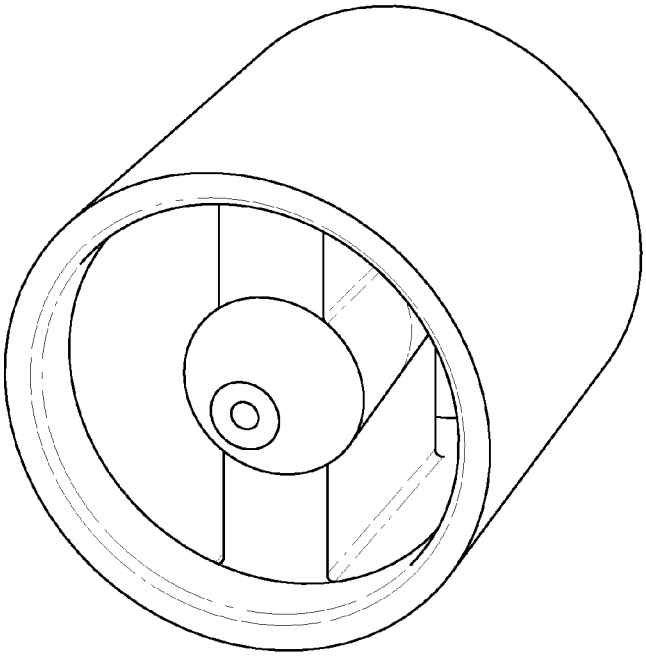
FIG. 1*c* shows a perspective view of an additive release component according to the first embodiment.
Figure 1D:
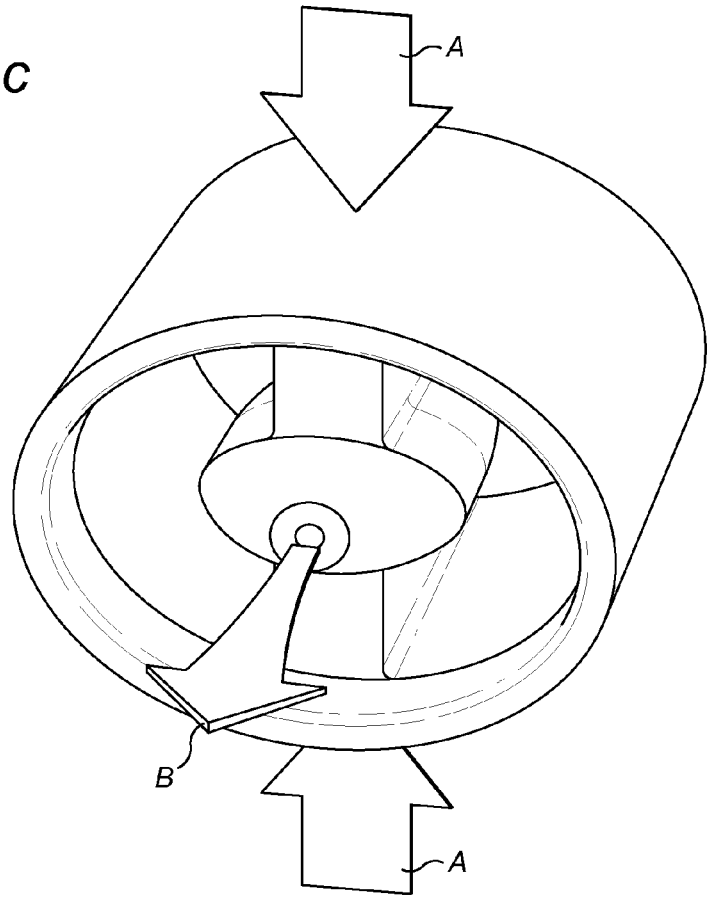
FIG. 1*d* shows a perspective view of the additive release component as shown in FIG. 1*c* when deformed by the application of compressive force.

FIGS. 1*c* and 1*d* also show an additive release component according to the first embodiment of the invention as shown in FIGS. 1*a* and 1*b* discussed above. FIG. 1*c* shows how the outer wall and the inner wall of the additive release component are substantially cylindrical when no compressive force is applied. FIG. 1*d* shows how the outer wall and the inner wall of the additive release component are deformed when compressive force is applied as indicated by the arrows A. As the chamber holding the additive is compressed as a result of the deformation of the inner and outer wall sections, pressure increases within it, the seal closing the release aperture is broken and the additive is released, as indicated by arrow B. Increased force results in increased flow. The form of the additive release component may or may not recover depending on the elasticity of the material. If the form recovers release of the additive may reduce or stop.

FIGS. 2*a* to 2*d* show an additive release component 11 according to a second embodiment. The component 11 is resiliently deformable and is configured to release one of a plurality of discrete deliveries of additive when compressive force is applied as indicated by the arrows.

The additive release component 11 comprises an outer wall section 12 and an inner wall section 13 connected together by bridging structures 14. The inner wall section 13 defines a chamber 20 for containing additive. There are longitudinal channels 15 through which air and/or smoke may flow, and there is a filling aperture 16 at one end that is sealed and/or covered during manufacture by a sealing structure 17 which is a cap fitting over and/or into the filling aperture. At the other end of the component 11, there is provided a slit valve 18. In the illustrated embodiment, the slit valve is a slit which forms a release aperture in the chamber 20. The slit may be sealed by heat sealing the edges to one another. In an alternative embodiment, the valve may be sealed and/or covered by a sheet of rupturable material (not shown).

Figure 2A:
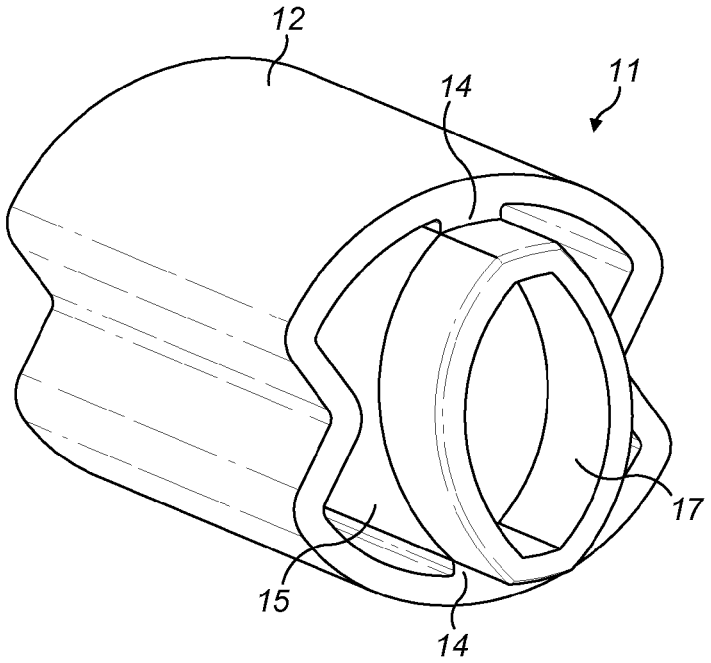
FIG. 2*a* shows a perspective view of one end an additive release component according to a second embodiment.

During manufacture of the additive release component 11 according to the second embodiment, additive is inserted into the chamber 20 of the additive release component 11 through the filling aperture 16. Thereafter, the filling aperture 16 is covered and/or sealed by the addition of the sealing structure 17, such as a cap which may be sealed onto or into the filling aperture 16, as shown in FIG. 2*a*. The sealing structure may be sealed using any suitable sealing method, for example, heat sealing, wet sealing, or sealing by ultra-sonic welding.

Figure 2B:
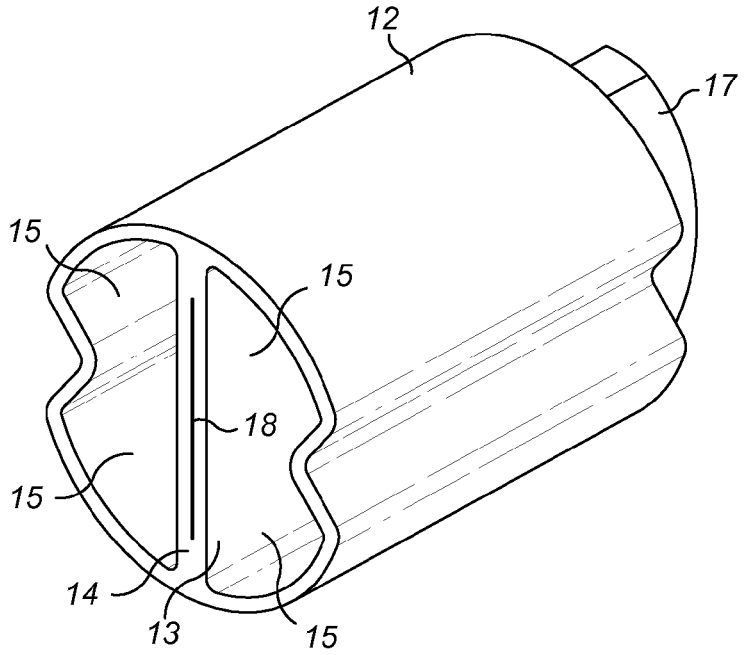
FIG. 2*b* shows a perspective view of the other end of an additive release component according to the second embodiment in the closed configuration.
Figure 2C:
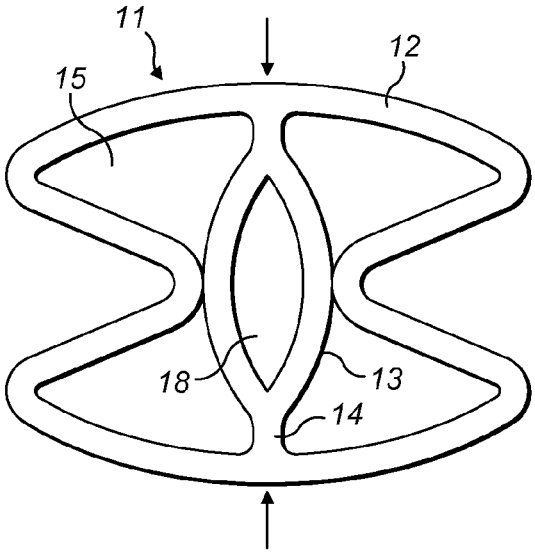
FIG. 2*c* shows a view of the other end of an additive release component according to the second embodiment in the open configuration.
Figure 2D:
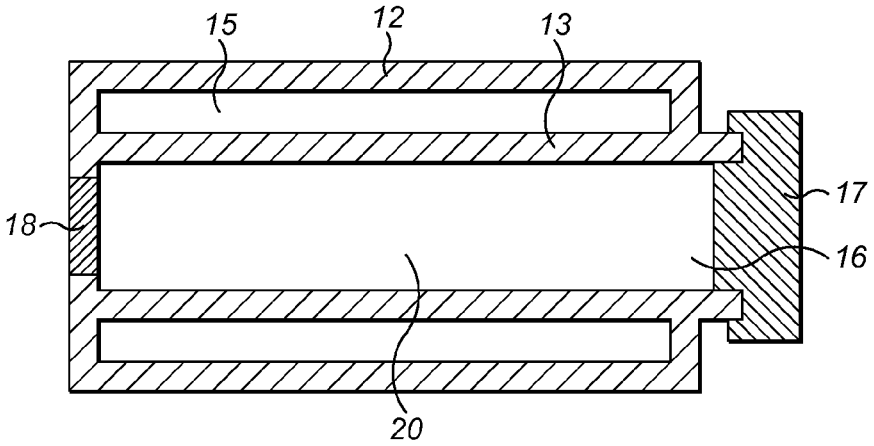
FIG. 2*d* shows a longitudinal cross-sectional view of an additive release component according to the second embodiment.

After manufacture, additive is initially not able to leave the additive release component 11. Both the filling aperture 16 and the release aperture 18 are sealed, as shown in FIG. 2*b*. Additive may be released from the component, however, when the first compressive force is applied to the outer wall 12 as indicated by the arrows in FIG. 2*c*, which shows how the release aperture in the opened configuration. The outer wall section 12 is compressed and the compressive force is transferred to the inner wall section 13 via the bridging structures 14, forcing apart the slit to open the release aperture 18. As the slit valve opens, any seal or cover is ruptured. Increased pressure increases the extent to which the release aperture 18 is opened. Depending on the elasticity of the material the aperture 18 may recover when the force is released, closing the slit to reduce or stop the release of additive. In alternative embodiments, the aperture 18 may remain open.

When the compressive force is no longer applied, the additive release component 11 reverts to its original shape and size. This pulls the sides of the slit valve together, effectively sealing it once again. The resilient nature of the material surrounding the release aperture 18 helps to seal the aperture when no compressive force is being applied. The release of additive is thereby prevented. Compressive force may be applied again to release another discrete delivery of additive, and this may be repeated until there is substantially no more additive left in the component for release.

The additive release component according to any of the embodiments described herein may, for example, be injection moulded, and may be injection moulded using, for example, polyvinyl alcohol (PVOH) and/or polyethylene (PE). The component may also comprise other or further materials, and may be formed by other manufacturing processes.

An additive is anything that may be added to the smoke flow path of a smoking article. Additive may be added in this way in order to modify the composition of the smoke or modify the properties of the smoke produced by the smoking article, for example. An additive may be a solid, such as a powder; a liquid, such as a liquid flavourant; or a gas, such as an aromatic composition. The additive may be a flavourant, a deodoriser, a diluent, an adsorbent, or any other substance that is capable of modifying the gaseous flow. In addition, the additive may be water, and, where local regulations permit, the additive may be a flavourant.

As used herein, the terms "flavour" and "flavourant" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamon, celery, cascarilla, nutmeg, sandalwood, bergamot, geranium, honey essence, rose oil, vanilla, lemon oil, orange oil, *cassia*, caraway, cognac, jasmine, ylang-ylang, sage, fennel, piment, ginger, anise, coriander, coffee, or a mint oil from any species of the genus *Mentha*), flavour enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

The flavour may be a tobacco flavour. Where the flavour is delivered in liquid form the tobacco flavour could be derived from tobacco extract. Where the flavour is derived from a solid product, the product could be tobacco leaf in shredded, particulate or granular form, or in the form of reconstituted tobacco sheet material.

The incorporated additive may be of any viscosity, as long as it is able to be released from the additive release component. Any suitable substance may be mixed with the additive in order to modify its viscosity, if necessary. An example of a suitable substance is polyethylene glycol (PEG), the molecular weight of the PEG being selected to provide a desired viscosity.

The additive release component 1 according to any of the embodiments may comprise any suitable additive. The additive may, for example, be a solution of menthol dissolved in any suitable oil, such as a solution of menthol in a Miglyol® oil in a concentration ratio of approximately 1:3.

The inner wall section of the additive release component may be coated with a varnish or any other suitable waterproof material, such as silicone. Doing so may help preserve the rigidity of the additive release component material by preventing the absorption of, and/or degradation by, the contained additive over time.

In some embodiments, the additive release component may comprise two or more compartments for holding additive.

In some embodiments, the inner wall section defines a chamber within which the additive is contained, and this chamber may be divided into two or more separate compartments. The chamber may be divided into two or more separate compartments by one or more septa or barriers. In some embodiments, the septa and/or barriers may be composed from the same material as other components of the additive release component, such as the wall sections. The septa or barriers may be frangible or may be highly resistant to fracture, due to being highly robust or flexible for example. There may be one or more additives contained within the chamber, and there may be one or more additives contained within each compartment of the chamber.

In embodiments where the chamber comprises two or more separate compartments, each compartment may comprise a different additive. Consequently, the additives contained in each section would be isolated from one another during storage.

Isolation of additives from one another during storage could, alternatively or in addition, be achieved by the encapsulation of one or more of the additives prior to their incorporation into the additive release component.

In another embodiment, two of more additive release components are incorporated into the smoking article, each additive release component optionally comprising a different additive.

Isolation of the additives from one another during storage could be advantageous. For example, isolation of different additives could make it possible for different additives to be released in different directions upon actuation. In a single component, for example, each isolated compartment of the chamber could have its own release aperture, allowing different additives to be released from their respective compartments in different directions.

In some embodiments, an additive release component is provided with one or more release apertures at each end. The component further comprises a chamber divided into two compartments, each compartment being arranged to expel its additive through the release aperture(s) at a different end of the component. Thus, for example, one additive may be released towards the buccal end of the smoking article, while the other additive may be released towards the tobacco end of the smoking article.

In some embodiments, isolation of multiple additives in an additive release component during storage may ensure that the additives are only mixed together upon actuation. For example, the stored additives could be released and mixed to generate a product that would be unsuitable for storage—for example because it is too kinetically unstable or too volatile. Alternatively or in addition, the additives could react with one another upon mixing. For example, they could undergo an exothermic or endothermic reaction to change the temperature of the surrounding environment upon actuation.

Additive may be released from the additive release component through one or more apertures in one or more predetermined directions. Predetermined directional release of additive can make the distribution of additive from the component more efficient and/or the additive may be released to one or more particular regions of the smoking article. These regions may be anywhere in the smoking article, and additive may be directed towards a cavity in the filter of the smoking article, for example.

It may be desirable to release additive into a particular region of the smoking article for various reasons. For example, there may be one or more substances contained in the region that are able to interact with the released additive. For example, the substance could be a solute of the additive that is only activated when it is contacted by the additive. For example, the substance could change colour, dissolve, make a sound, emit a flavour, and/or release an odour, when contacted with additive. The substance could also be stored in the smoking article in any suitable form. It could be stored as an even distribution of small granules, for example, advantageously providing a large surface area:volume ratio maximise the rate of reaction upon contact with the additive.

Figure 3:
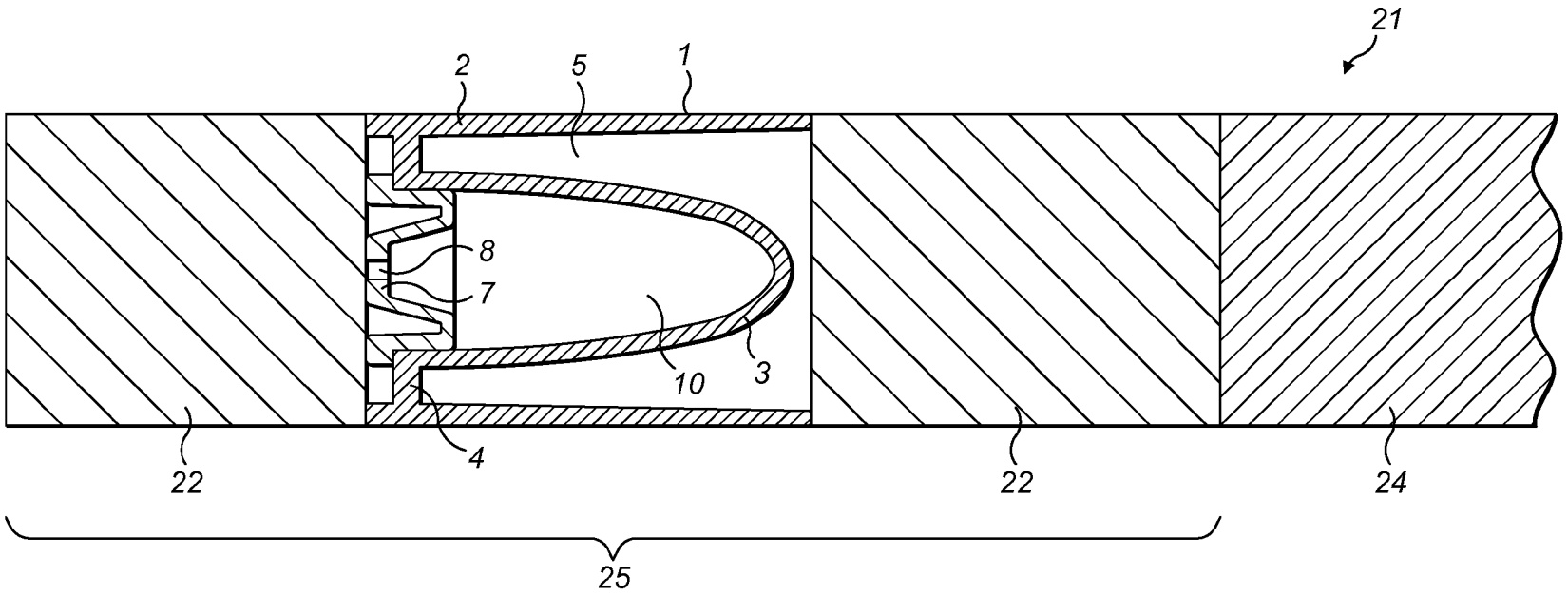
FIG. 3 shows a cross-sectional view of an additive release component in a smoking article.

An additive release component, such as the component according to the first embodiment described above and illustrated in FIGS. 1*a* and 1*b* may be located in a smoking article, as shown in FIG. 3.

In the embodiment illustrated, the additive release component 1 is positioned within the filter section 25 of the smoking article 21. The component 1 substantially fills the cross-section of the filter section 25. The longitudinal channels 5 through the additive release component 1 enable the component to fill the cross-section without causing significant draw resistance (i.e. pressure drop) during use of the smoking article 21, since they provide paths through which air and/or smoke may flow.

The additive release component 1 is substantially aligned with the longitudinal axis of the smoking article 21. In the illustrated embodiment, plugs of filter material 22, for example comprising plasticized cellulose acetate tow abut each end of the additive release component 1. The additive release component may be surrounded by the tipping paper which holds the filter section to the rod of smokeable material 24. In some embodiments, the additive release component may also be surrounded by another sheet wrapper material. However, in some embodiments, the additive release component is preferably not surrounded around its outer circumference by a layer of filter material, or the like, or by a substantial gap or void. In some embodiments, little or no airflow is seen around the additive release component, i.e. over the external surface of the outer wall section of the additive release component.

In some embodiments, a single additive release component is incorporated into a smoking article. In other embodiments, multiple additive release components may be included in a single smoking article. The one or more additive release components may be positioned within the filter section of the smoking article and/or in the rod of smokeable material (where the materials used in the component, before and/or after combustion, comply with and/or are subject to applicable regulatory requirements/approvals).

The filter into which the additive release component may be incorporated may comprise a transparent or translucent window to enable the user of the smoking article to see the additive release component. One or more transparent or translucent windows may be provided in the tipping paper, or any other suitable wrapping paper. The tipping paper, or any other suitable wrapping paper, may comprise a piece of transparent or translucent material that may be, but is not limited to: polypropylene, polyvinyl chloride (PVC), cellulose acetate film, polyethylene terephthalate (PET), polyethylene oxide (PEOX), polyethylene, cellophane, Natureflex™, polylactic acid, plastarch material, polycaprolactone, polyglycolide, a polyhydroxyalkanoate such as poly-3-hydroxybutyrate, or zein-derived bioplastics. The tipping paper, or any other suitable wrapping paper, may be coated in certain sections with an opaque material in order to leave uncoated transparent or translucent windows.

In some embodiments, the filter comprises a single transparent window that wraps completely around the circumference of the filter to form a cylindrical section of the smoking article filter. For example, the filter comprises a transparent window as described along with a single cavity containing a single additive release component that can be seen through the transparent window.

It can be advantageous for the user of the smoking article to be able to see the additive release component as this may allow the user to see where the component is, to know where to apply compressive force in order to initiate the release of additive, to identify whether or not additive has been released, and/or to see how much additive has been released.

The additive release component may be coloured. Alternatively or in addition, the additive contained within the component may be coloured, which may, advantageously, enable the user of the smoking article to see the additive and therefore know when, and how much, additive has been released. If two or more additives are contained in the component, the additives may have different colours in order to allow the user to distinguish them and recognise which of them has been released.

If the incorporated additive is coloured, it may be desirable for the additive release component to release the coloured additive into a region of the smoking article or smoking article filter where it can be seen. The additive may be released into a peripheral region of the smoking article for this purpose, such as a circumferential or buccal end region of the smoking article. Alternatively or in addition, the coloured additive may be directionally released into a region of the smoking article that is visible via a transparent or translucent window.

In some embodiments, the filter comprising an additive release component of the invention comprises a wicking element. A wicking element may be incorporated into the smoking article in order to influence how additive is distributed from the additive release component.

A wicking element may be positioned next to the additive release component in order to dictate the direction in which additive is mainly released. Alternatively or in addition, a wicking element may be used to dictate the direction in which additive is mainly transported after it has been released.

Additive is preferentially drawn along or through a wicking element, and may permeate through a wicking element more quickly than it permeates through the other material into which the additive is released, for example, the filter material. In this way, a wicking element can dictate the direction in which additive is mainly dispersed and/or the distance over which additive moves. Consequently, the incorporation of a wicking element of a particular shape and in a particular position can make it possible to control, to some extent at least, the region into which additive is mainly dispersed.

Thin strands of absorbent material are particularly effective wicking elements for transporting additive over longer distances. Is some embodiments, one or more strands of wicking material may radiate from the additive release component, providing paths along which additive may be transported, and potentially navigating additive towards the external surface of the smoking article.

Any suitable material may be used as a wicking element, such as undraped cellulose acetate thread; other cellulosic materials, such as hydroxymethyl cellulose; starch; and foamed polyvinyl alcohol.

The additive release component may be inserted into the smoking article or smoking article filter using any suitable method of insertion.

In some embodiments it is necessary for the additive release component to release additive in a predetermined direction, in which case it is also necessary for the orientation of the additive release component in the smoking article to be controlled.

The insertion method may comprise any suitable steps for controlling the orientation of the component upon insertion.

In some embodiments, the shape of the additive release component may be utilised to control how the additive release component is orientated when inserted into the smoking article. Different three-dimensional shapes have different distributions of mass and therefore have their centre of mass in different locations. Importantly, the centre of mass location may determine the equilibrium geometry assumed by the shape, and may therefore be used to control how the additive release component is orientated upon insertion.

Any suitable apparatus may be used in the insertion process. Suitable apparatus may, for example, include a means for supplying a continuous stream of filter material from a source of filter material, which may be a bale or a bobbin for example. In addition, there may be an additive release component insertion unit for inserting or depositing individual additive release components at predetermined intervals along the filter material. The additive release component-containing filter material may then be received by a rod-making means, the rod-making means providing a continuous rod to be subdivided at predetermined intervals to form individual filters of the desired length.

The insertion method may comprise any suitable alternative or additional steps. For example, known dual or triple filter combining techniques may be used, the additive release component may be inserted into a cavity within the filter, and/or the component may be incorporated into a filter using a vertical feed method.

Embodiments of the invention are configured to comply with applicable laws and/or regulations, such as, by way of non-limiting example, regulations relating to flavours, additives, emissions, constituents, and/or the like. For example, the invention may be configured such that a smoking article implementing the invention is compliant with applicable regulations before, during and after the release of a smoke modifying agent from a capsule.

In order to address various issues and advance the art, the entirety of this disclosure shows by way of illustration various embodiments in which the claimed invention(s) may be practiced and provide for superior additive release components and products including the same. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. An additive release component for a smoking article, wherein the additive release component is deformable and configured to provide:

an additive release aperture through which additive may be released;

an outer wall section;

an inner wall section that defines an additive holding chamber within which additive is held; and at least one channel between the inner and outer wall sections to allow airflow through the component;

wherein the component is configured to transmit a compressive force applied to the outer wall section to the inner wall section and to open the additive release aperture, wherein the aperture is sealed to prevent the release of additive through said aperture prior to a first application of compressive force to the outer wall section, and wherein the first application of compressive force to the outer wall section opens the aperture to allow release of additive through said aperture; and wherein the aperture closes once the compressive force is no longer applied, so that substantially no additive is released until a compressive force is applied once more.

2. The additive release component according to claim 1, wherein the additive release component is resiliently deformable.

3. The additive release component according to claim 1, wherein at least one of an at least one bridge and an at least one vane connects the outer wall section to the inner wall section.

4. The additive release component according to claim 1, wherein the component is configured to release a plurality of discrete deliveries of additive.

5. The additive release component according to claim 1, wherein the additive release aperture is a slit valve.

6. The additive release component according to claim 1, wherein the additive release aperture is sealed by a plug comprising a rupturable material.

7. The additive release component according to claim 1, wherein the additive holding chamber comprises two compartments, and wherein the first compartment contains a first additive and the second compartment contains a second additive, the second additive being different from the first additive.

8. The additive release component according to claim 1, wherein at least part of the component comprises at least one of injection moulded polyvinyl alcohol and injection moulded polyethylene.

9. A method of manufacturing the additive release component according to claim 1, comprising: forming the inner wall section that defines the additive holding chamber; forming the outer wall section; introducing additive into the additive holding chamber; and adding a sealing structure to seal the additive holding chamber.

10. A filter for a smoking article comprising an additive release component, wherein the additive release component is deformable and configured to provide: an additive release aperture through which additive may be released; an outer wall section; an inner wall section that defines an additive holding chamber within which additive is held; and at least one channel between the inner and outer wall sections to allow airflow through the component; wherein the component is configured to transmit a compressive force applied to the outer wall section to the inner wall section and to open the additive release aperture; wherein the aperture is sealed to prevent the release of additive through said aperture prior to a first application of compressive force to the outer wall section, and wherein the first application of compressive force to the outer wall section opens the aperture to allow release of additive through said aperture; and wherein the aperture closes once the compressive force is no longer applied, so that substantially no additive is released until a compressive force is applied once more.

11. The filter according to claim 10, further comprising a window to enable the user to see the additive release component, wherein the window is at least one of transparent and translucent.

12. The filter according to claim 10, further comprising a wicking element.

13. The filter according to claim 10, wherein the additive release component is substantially aligned with the longitudinal axis of the filter.

14. A smoking article comprising an additive release component, wherein the additive release component is deformable and configured to provide: an additive release aperture through which additive may be released; an outer wall section; an inner wall section that defines an additive holding chamber within which the additive is held; and at least one channel between the inner and outer wall sections to allow airflow through the component; wherein the component is configured to transmit a compressive force applied to the outer wall section to the inner wall section and to open the additive release aperture; wherein the aperture is sealed to prevent the release of additive through said aperture prior to a first application of compressive force to the outer wall section, and wherein the first application of compressive force to the outer wall section opens the aperture to allow release of additive through said aperture; and wherein the aperture closes once the compressive force is no longer applied, so that substantially no additive is released until a compressive force is applied once more.

* * * * *